US010925399B2

(12) United States Patent
Miles et al.

(10) Patent No.: US 10,925,399 B2
(45) Date of Patent: Feb. 23, 2021

(54) MODULAR ORGANIZER SYSTEMS

(71) Applicant: RDLL Investments LLC, Portland, OR (US)

(72) Inventors: Raye Miles, Portland, OR (US); Douglas Porter, Salem, OR (US); John Dorrance, Lake Oswego, OR (US); Kenneth Courian, Portland, OR (US)

(73) Assignee: RDLL Investments LLC, Portland, OR (US)

( * ) Notice: Subject to any disclaimer, the term of this patent is extended or adjusted under 35 U.S.C. 154(b) by 143 days.

(21) Appl. No.: 16/001,794

(22) Filed: Jun. 6, 2018

(65) Prior Publication Data

US 2018/0344029 A1 Dec. 6, 2018

Related U.S. Application Data

(60) Provisional application No. 62/515,812, filed on Jun. 6, 2017.

(51) Int. Cl.
*A47B 88/975* (2017.01)

(52) U.S. Cl.
CPC ..... *A47B 88/975* (2017.01)

(58) Field of Classification Search
CPC .... A47B 88/974; A47B 88/975; B65D 25/04; B65D 25/06
See application file for complete search history.

(56) References Cited

U.S. PATENT DOCUMENTS 3,951,294 A * 4/1976 Wilson ..... B65F 1/02 220/4.31
4,488,653 A 12/1984 Belokin
4,595,246 A 6/1986 Bross
4,768,661 A 9/1988 Pfeifer
(Continued)

OTHER PUBLICATIONS

"6Pcs DIY Grid Drawer Divider Household Necessities Storage Organizer Plastic New", Ebay, http://www.ebay.com/tm/6Pcs-DIY-Grid-Drawer-Divider-Household-Necessities-Storage-Organizer-Plastic-New-/141870544899, originally retrieved from internet Jun. 22, 2017, 9 pages.

(Continued)

*Primary Examiner* — Anthony D Stashick
*Assistant Examiner* — Blaine G Neway
(74) *Attorney, Agent, or Firm* — Chernoff Vilhauer LLP

(57) ABSTRACT

Modular organizer systems and components thereof are disclosed. In some embodiments, a first panel may include a plurality of elongate and parallel structural members and a plurality of bridges that are attached to, or formed with, a first portion of the plurality of structural members such that (a) a bridge spans between the first portions of each pair of adjacent structural members and (b) a cavity is defined between second portions of each pair of adjacent structural members. Bridge(s) may be sized to be received in a cavity of a second panel. The first panel may additionally include a projection assembly having a projection member and a projection bridge, which may be configured to be received in the second end structural member of a third panel. The second end structural member may include an opening configured to receive at least a portion of a projection assembly of a fourth panel.

17 Claims, 11 Drawing Sheets

(56) References Cited

U.S. PATENT DOCUMENTS

| | | | | |
|---|---|---|---|---|
| 4,884,689 | A * | 12/1989 | Su-Chin | A45C 13/02 206/372 |
| 4,889,253 | A | 12/1989 | Schmulian et al. | |
| 5,423,463 | A * | 6/1995 | Weeks | B60R 7/02 224/403 |
| 5,524,980 | A | 6/1996 | Carter et al. | |
| 5,536,111 | A * | 7/1996 | Doernemann | E02B 3/04 405/16 |
| 5,664,856 | A | 9/1997 | Pacetti | |
| 5,803,276 | A | 9/1998 | Vogler | |
| 5,971,173 | A | 10/1999 | Valiulis et al. | |
| 6,174,116 | B1 * | 1/2001 | Brand | B60P 7/14 410/121 |
| 8,317,442 | B2 * | 11/2012 | Daikuzono | B60P 7/14 410/121 |
| 8,628,155 | B1 | 1/2014 | Nielson | |
| 2009/0261049 | A1 | 10/2009 | McQuary et al. | |
| 2015/0164223 | A1 | 6/2015 | Lawson | |
| 2015/0305501 | A1 | 10/2015 | Brown | |

OTHER PUBLICATIONS

"Clear Stackable Shirt & Accessory Drawer Case of 3", Container Store, http://www.containerstore.com/s/clear-stackable-shirt-accessory-draw-case-of-3/d?productId=11008452&q=10009503, originally retrieved from internet Jun. 22, 2017, 2 pages.

"Höfta Divider for drawer", IKEA, https://www.ikea.com/ae/en/catalog/products/20282107, originally retrieved from internet Jun. 22, 2017, 3 pages.

"Strong Adjustable Drawer Organiser Drawer Divider Universal For Kitchen Bedroom", Home then garden Ebay, http://www.ebay.com/itm/Strong-Adjustable-Drawer-Divider-Universal-For-Kitchen-Bedroom/332491344219, originally retrieved from internet Jun. 22, 2017, 3 pages.

* cited by examiner

MODULAR ORGANIZER SYSTEMS

CROSS-REFERENCE TO RELATED APPLICATIONS

This application claims the benefit of U.S. Provisional Patent Application Ser. No. 62/515,812, which was filed on Jun. 6, 2017 and entitled "Modular Organizer Systems." The complete disclosure of the above application is hereby incorporated by reference for all purposes.

FIELD OF THE DISCLOSURE

This disclosure generally relates to systems and methods for organizing, storing, and/or segregating a variety of items. More specifically, the disclosed embodiments relate to modular organizer systems that are adjustable and customizable to a user's desired configuration.

BACKGROUND OF THE DISCLOSURE

Many homes and businesses rely on drawers and similar compartments to store a vast variety of items, including office supplies, electronics, books, clothing, shoes, jewelry, kitchen tools, art supplies, etc. Drawers come in a vast array of sizes and arrangements and are very common. For example, they can be found in various types of furniture, such as desks, cabinets, vanities, and dressers, as well as in closets, kitchens, offices, bedrooms, and bathrooms. However, efficient use of the storage space they provide is often challenging. Another common challenge is a fast and easy retrieval of the stored items. Conventional drawers generally lack internal structures or partitions for separately grouping the items contained within a drawer. Without some organizational structure within the drawer, the contents tend to shift away from a desired location in the drawer due to the drawer's motion, which results in the stored items becoming intermixed. Not only can this make it difficult to locate a particular item, but the drawer contents may be further mixed and moved around as a user is searching for the particular item, thereby causing further disorganization.

The challenge of organizing items in drawers and maintaining such organization has been addressed. However, each proposed organizational structure has its own drawbacks, which include complex assembly and installation, limited structural stability, adjustability and customizability, and short durability.

SUMMARY OF THE DISCLOSURE

The present disclosure provides systems, apparatuses, and methods relating to modular organizer systems. In some embodiments, a first panel may include a plurality of elongate and parallel structural members. Each structural member of the plurality of structural members may have a first portion and a second portion. The first panel may additionally include a plurality of bridges that are attached to, or formed with, the first portion of the plurality of structural members such that (a) a bridge of the plurality of bridges spans between the first portions of each pair of adjacent structural members of the plurality of structural members and (b) a cavity is defined between the second portions of each pair of adjacent structural members of the plurality of structural members. One or more bridges of the plurality of bridges may be sized to be received in a cavity of a second panel to attach the first and second panels together. The plurality of structural members may include a first end structural member, an opposed second structural end member, and the remainder of structural members of the plurality of structural members therebetween.

The first panel may further include a projection assembly attached to, or formed with, the first portion of the first end structural member. The projection assembly may include a projection member and a projection bridge that spans between the projection member and at least the first portion of the first end structural member. The projection member and a portion of the projection bridge may be configured to be received in the second end structural member of a third panel to attach the first and third panels together. The second end structural member may include an opening configured to receive at least a portion of a projection assembly of a fourth panel to attach the first and fourth panels together.

In some embodiments, a modular organizer system may include a plurality of panels. Each panel of the plurality of panels may include a plurality of elongate and parallel structural members including a first end structural member, an opposed second structural end member, and the remainder of structural members therebetween. Each structural member of the plurality of structural members may have a first portion and a second portion. Each panel of the plurality of panels may additionally include a plurality of bridges that are attached to, or formed with, the first portion of the plurality of structural members such that the second portion of each structural member of the plurality of structural members is spaced apart from the second portion of an adjacent structural member of the plurality of structural members to define a cavity therebetween. One or more bridges of the plurality of bridges may be sized to be received in a cavity of another panel of the plurality of panels.

Each panel of the plurality of panels may further include a projection assembly attached to, or formed with, the first portion of the first end structural member. At least a portion of the projection assembly may be configured to be received in a second end structural member of another panel of the plurality of panels. The second end structural member may include an opening configured to receive at least a portion of a projection assembly of another panel of the plurality of panels.

In some embodiments, a modular organizer system may include a plurality of panels. Each panel of the plurality of panels may include a plurality of elongate and parallel structural members, each structural member of the plurality of structural members having a first portion and a second portion. The plurality of structural members may include a first end structural member, an opposed second structural end member, and the remainder of structural members of the plurality of structural members therebetween.

Each panel of the plurality of panels may additionally include a plurality of bridges that are attached to, or formed with, the first portion of the plurality of structural members such that (a) a bridge of the plurality of bridges spans between the first portions of each pair of adjacent structural members of the plurality of structural members and (b) a cavity is defined between the second portions of each pair of adjacent structural members of the plurality of structural members. Each bridge of the plurality of bridges may be sized to be received in one or more cavities of another panel of the plurality of panels. The plurality of structural members may have a first thickness and the plurality of bridges may have a second thickness that is substantially less than the first thickness.

Each panel of the plurality of panels may further include a projection assembly attached to, or formed with, the first portion of the first end structural member. The projection assembly may include a projection member and a projection bridge that spans between the projection member and at least the first portion of the first end structural member. The projection member and a portion of the projection bridge may be configured to be received in the second end structural member of another panel of the plurality of panels. The second end structural member may include an opening configured to receive at least a portion of the projection assembly of another panel of the plurality of panels.

The modular organizer system may additionally include a fastener assembly having a fastener base and at least two connectors attached to the fastener base. One or more structural members of the plurality of structural members may include an end portion having an aperture. The aperture may be sized to receive a connector of the at least two connectors of the fastener assembly. The modular organizer system may further include a base having a plurality of base openings. Each base opening of the plurality of base openings may be sized to receive a connector of the at least two connectors. The fastener assembly may be configured to attach the base to a panel of the plurality of panels when one or more connectors of the at least two connectors are received in one or more base openings of the plurality of base openings and are received in the aperture of the end portion of the one or more structural members.

Features, functions, and advantages may be achieved independently in various embodiments of the present disclosure, or may be combined in yet other embodiments, further details of which can be seen with reference to the following description and drawings.

DETAILED DESCRIPTION

Figure 1:
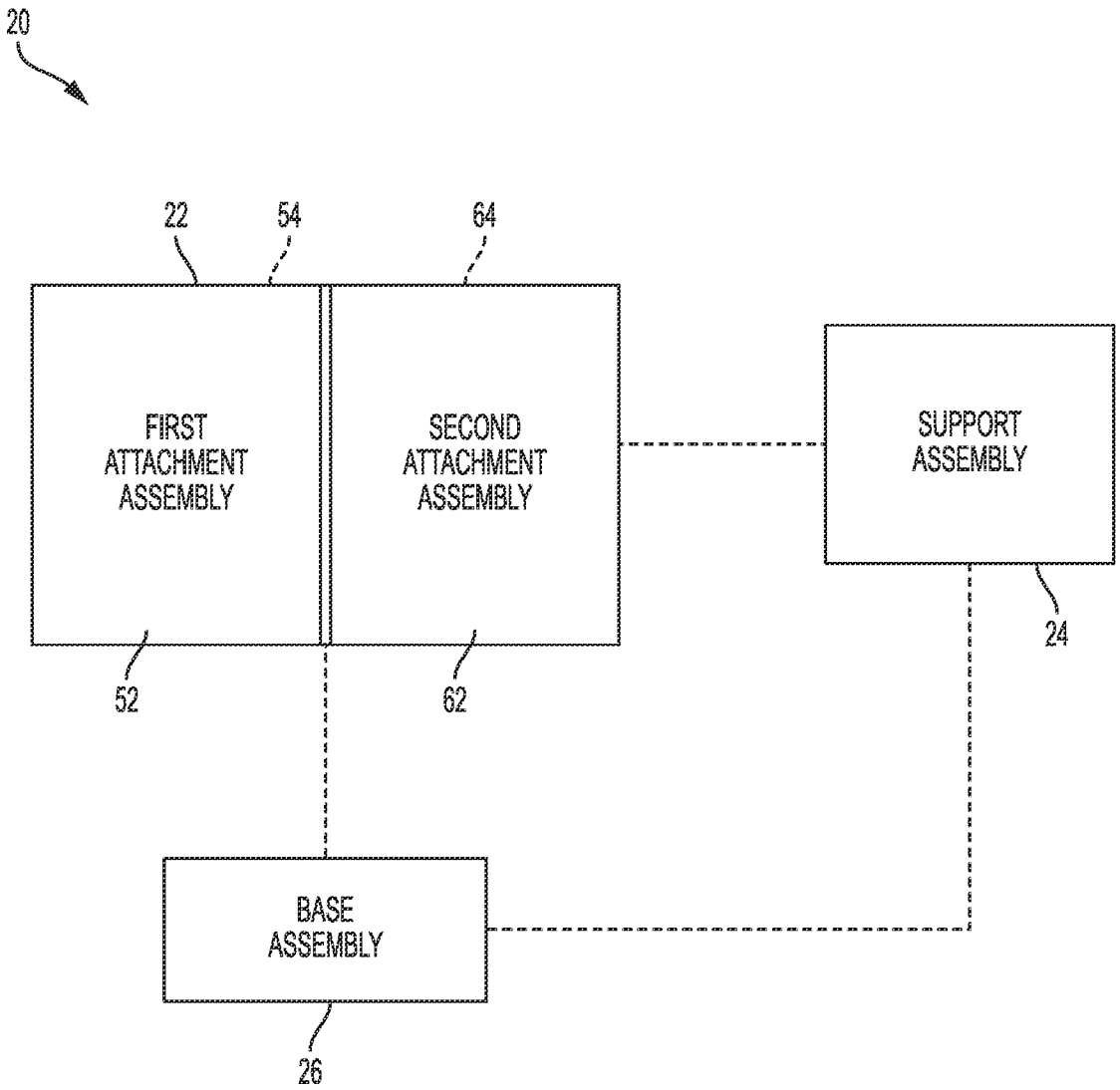
FIG. 1 is a block diagram of an example of a modular organizer system in accordance with aspects of the present disclosure.

Various aspects and examples of modular organizer systems are described below and illustrated in the associated drawings. Unless otherwise specified, modular organizer systems in accordance with the present teachings, and/or its various components may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Illustrative Combinations and Additional Examples; and (5) Conclusion. The Examples, Components, and Alternatives section is further divided into subsections 1 and 2, each of which is labeled accordingly.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

"Coupled" means connected, either permanently or releasably, whether directly or indirectly through intervening components, and is not necessarily limited to physical connection(s).

Overview

In general, modular organizer systems in accordance with the present teachings may include one or more panels having elongate, parallel, and spaced-apart structural members connected by bridges and a projection assembly connected to one or more of the structural members. In some embodiments, the modular organizer systems may include one or more fastener assemblies and/or one or more base assemblies.

EXAMPLES, COMPONENTS, AND ALTERNATIVES

The following sections describe selected aspects of exemplary modular organizer systems as well as related apparatuses and/or methods. The examples in these sections are intended for illustration and should not be interpreted as limiting the entire scope of the present disclosure. Each section may include one or more distinct embodiments or examples, and/or contextual or related information, function, and/or structure.

Example 1

FIG. 1 is a block diagram of an example of a modular organizer system, generally indicated at 20. Modular organizer system 20 may include any suitable structure configured to organize, sort, and/or segregate items within individual compartments and permit a user to selectively adjust the arrangement and/or size of the individual compartments as desired. For example, modular organizer system 20 may include a panel assembly 22. In some examples, modular organizer system 20 may additionally include a support assembly 24 and/or a base assembly 26.

Modular organizer system 20 may be configured to be positioned in a horizontal orientation and/or a vertical orientation and may allow a user to easily switch between the different orientations. For example, the modular organizer system may be configured to lie flat in a drawer and/or positioned against a wall or other vertical surface. In some examples, modular organizer system 20 may be configured to be a free-standing structure (e.g. similar to a book shelf or shoe rack) and/or contained within an enclosed space (e.g. a drawer). Furthermore, modular organizer system 20 may be configured to attach to and/or incorporate with other modular organizer systems.

Panel assembly 22 may include any suitable structure configured to releasably connect together and/or align to form one or more individual compartments. For example, panel assembly 22 may include a plurality of panels configured to releasably connect and/or interlock with each other to form one or more individual compartments. Panels of panel assembly 22 may include one or more walls, partitions, screens, barriers, and/or any suitable combination. Additionally, the panel assembly may be easily assembled, disassembled, and reconfigured into different arrangements and/or shapes. The panels of panel assembly 22 may comprise any suitable material(s), such as plastic, ceramic, glass, rubber, or wood, and/or the like, or any suitable combination.

Support assembly 24 may include any suitable structure configured to facilitate and/or secure one or more components of the modular organizer system. For example, the support assembly may include a plurality of fasteners configured to releasably attach to one or more components of panel assembly 22 and/or base assembly 26. The plurality of fasteners may include one or more connectors, screws, pins, springs, tacks, or the like, or any suitable combination. In some examples, support assembly 24 may include a plurality of fasteners configured to releasably attach to one or more components of the panel assembly to secure and/or hold the panel assembly in a desired position and/or arrangement. In some examples, support assembly 24 may include a plurality of fasteners configured to releasably attach to one or more components of the base assembly. Support assembly 24 may comprise any suitable material(s), such as metal, plastic, rubber, among others.

Base assembly 26 may include any suitable structure configured to at least partially enclose and/or receive panel assembly 22. For example, base assembly 26 may include one or more bases, walls, panels, partitions, screens, barriers, or the like, configured to at least partially cover and/or extend across the panel assembly. The base assembly may be shaped and sized to receive the panel assembly. For example, the base assembly may have a rectangular shape, or other suitable shape(s). Base assembly 26 may be made of any suitable material(s), such as wood, plastic, metal, cardboard, foam, among others.

Panel assembly 22 may include any suitable structure configured to releasably connect together and/or align to form one or more individual compartments. For example, the panel assembly may include a first attachment assembly 52 configured to releasably attach and/or receive one or more additional panels in a perpendicular orientation relative to the additional panels. For example, first attachment assembly 52 may include one or more first connectors 54, which may be positioned along the panel(s) of the panel assembly in any suitable location(s). The first connectors may, for example, be positioned along a substantial portion of a length of one or more of the panels of the panel assembly. Alternatively, or additionally, the first connectors may be located in one or more end portions and/or one or more central portions of the panel(s).

Additionally, panel assembly 22 may include a second attachment assembly 62 configured to releasably attach and/or receive one or more additional panels in a longitudinal direction relative to the additional panels or to provide a parallel connection between two or more panels. For example, second attachment assembly 62 may include one or more second connectors 64, which may be positioned along the panel(s) of the panel assembly in any suitable location(s). The second connectors may, for example, be in only one or more end portions and/or only one or more central portions of the panels. Alternatively, or additionally, the second connectors may be distributed along a substantial portion of a length of one or more panels of the panel assembly.

First and/or second connectors 54, 64 may include any suitable structure for releasable attachment. For example, the first and second connectors may include hook and eye, tongue and groove, Velcro, temporary adhesive, and/or snap-fit mechanisms, among others. The first and second connectors may be incorporated or formed as part of the panel(s) of panel assembly 22, or may be separate structures that are otherwise coupled to the panel(s). Those connectors may comprise any suitable materials, and may be of the same material or different materials.

Although panel assembly 22 is shown to include both first and second attachment assemblies 52, 62, the panel assembly may include only the first attachment assembly or only the second attachment assembly, or may include one or more additional attachment assemblies that allow for connecting panels in directions the same or different from the above attachment assemblies. Additionally, although first and second attachment assemblies 52, 62 are described to allow for perpendicular and parallel connections, one or both of those assemblies may alternatively, or additionally, allow for oblique connections that are neither parallel nor perpendicular.

Example 2

Figure 2:
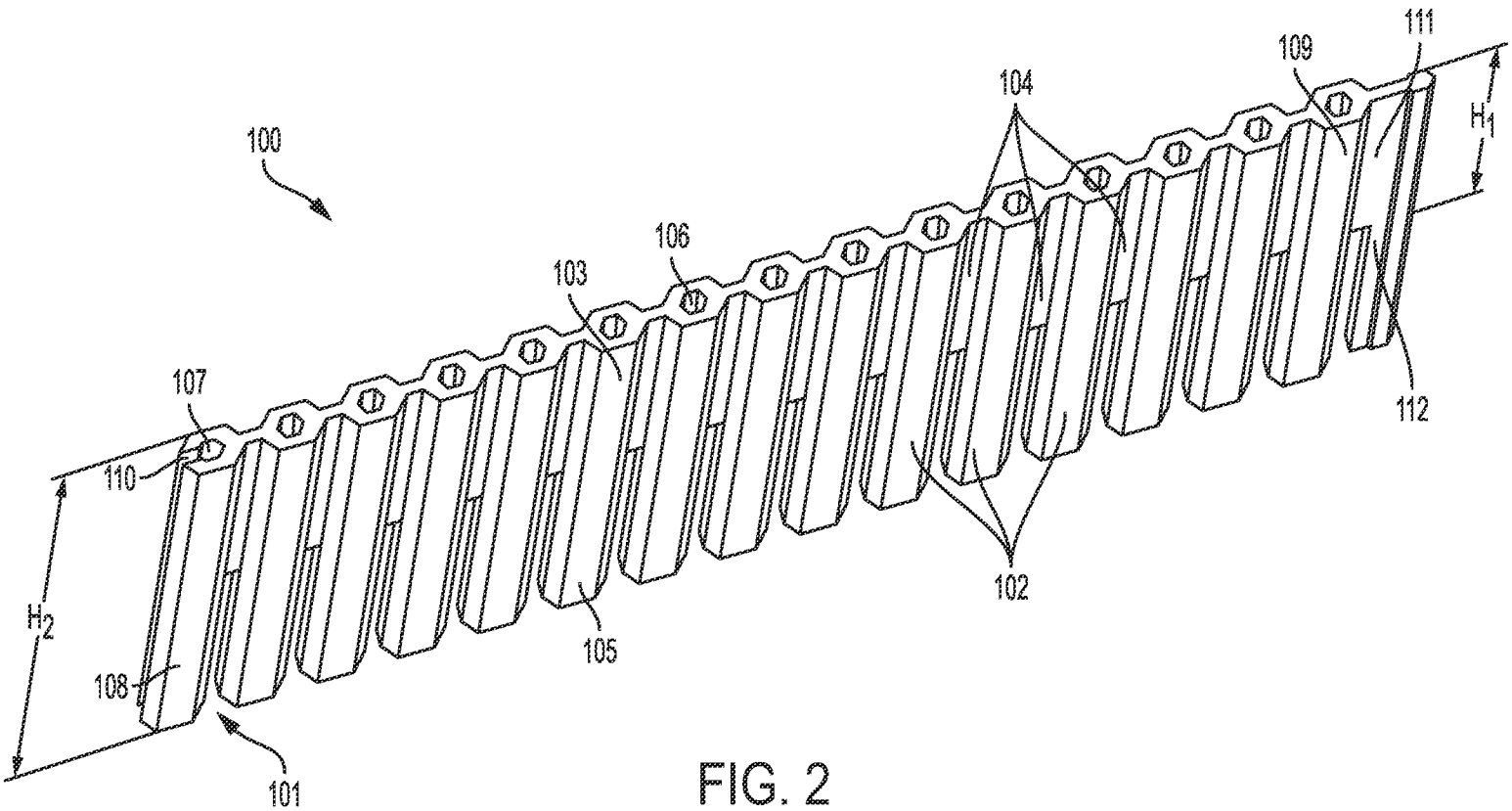
FIG. 2 is an isometric view of an example of a panel of a panel assembly of the modular organizer system of FIG. 1.

FIG. 2 shows an embodiment of a panel 100 of panel assembly 22. Panel 100 comprises a plurality of structural members or prongs 102 connected by, or formed with, a plurality of connecting portions or bridges 104. Prongs 102 may include a first portion 103 and a second portion 105. In some examples, first portion 103 may be an upper half portion of the prong across its height (or length), while second portion 103 may be a lower half portion of the prong across its height (or length). However, the first and second portions may have other relative sizes, such as ⅓-⅔ or ¼-¾. The prongs may be any suitable shapes and/or sizes. For examples, prongs 102 may be elongate, triangular, rectangular, etc. Additionally, the prongs may have any suitable relationships to each other, such as parallel and/or perpendicular.

Panel 100 may further include a plurality of bridges 104. As shown in the example of FIG. 2, a bridge 104 is disposed between one or more pairs (or each pair) of adjacent prongs to connect the first portions of those adjacent prongs in a spaced apart and parallel relationship. In other words, a bridge 104 may span between the first portions of one or more pairs (or each pair) of adjacent prongs 102. In the disclosed embodiment, the height (or length) of the bridges $H_1$ is about one half of the height (or length) of the prongs $H_2$. However, the height of the bridges may be any suitable height that is less than the height of the prongs, such as one third or one quarter of the height of the prongs. The prongs and/or its apertures (discussed below) may define a plurality of longitudinal axes and the $H_1$ and $H_2$ (or lengths) are measured parallel to those axes. The spaces between the second portions of the prongs not filled by the bridges define cavities 101, which may be used as slots for attaching panels, as explained below. As discussed above, the prongs and bridges alternate, with one bridge located between every pair of consecutive or adjacent prongs. However, two or more prongs may be adjacent each other without any bridges in other embodiments.

Although prongs 102 of equal height (or length), width, and thickness are shown in FIG. 2, one or more prongs 102 may have a height (or length), width, and/or thickness that are more or less than the height (or length) of the other prongs. In some embodiments, panel 100 may include prongs of various dimensions allowing for selective connection with other panels. The prongs, bridges, and projection assembly may be formed together as a unitary piece. Alternatively, one or more of the prongs, bridges, or projection assembly may be discrete piece(s) attached together to form the panel.

Each prong is hollow with an aperture 106 extending throughout the entire height $H_2$ of the prong. However, in other embodiments, aperture 106 may not extend throughout the entire height (or length), such as partially or substantially throughout the entire height (or length). Alternatively, one or more prongs may not be hollow with only some of the prongs having an aperture 106 and, in some embodiments, all the prongs are not hollow.

In the disclosed embodiment each prong 102 has outer shape of a hexagonal prism with bridges connecting to a prong along opposite longest edges of the prism. The apertures 106 are also hexagonal. Cross sectional view of a prong in a plane perpendicular to its height comprises two concentric hexagons, internal and external, material of which the panel is made filling the space between the hexagons. However, in other embodiments, the internal and external shapes of one or more (or all) of the prongs may be different. For example, apertures 106 may be circular with the outer shape of the prong being a hexagonal prism. In the example of FIG. 2, the internal and external hexagons are non-equilateral, with two long opposing edges of the same length, and four short edges of the same length. However, in other embodiments, the internal and/or external hexagons may be equilateral. The outer shape of the prongs and the shape of the prongs' apertures are not limited to those of the disclosed embodiment and may comprise variety of geometrical shapes with cross sections such as polygons, ovals, circles, and/or suitable combinations.

A first end of panel 100 comprises a first end structural member, first end prong, or slit prong 108. Slit prong 108 may be the same shape and dimensions as other prongs, but may differ from other prongs by comprising a slit or opening 110 extending along any suitable portion of (or all of) its height. The slit 110 may be along the prism edge opposite to the edge attached to the bridge that connects the slit prong 108 with the rest of panel 100. The slit 110 has a width selected to accommodate a tongue bridge of another panel, as further discussed below.

At a second end of panel 100, there is a tongue prong 112 also attached to, or formed with, a second end structural member or second end prong 109 by a tongue bridge 111. Tongue bridge 111 may be the same thickness and/or width as bridge 104, or may be a different thickness and/or width. Tongue prong 112 is configured to be received in aperture 107 of the slit prong. The height of tongue prong 112 may match (or may be less than) the height of other prongs. Tongue prong 112 may have any cross-sectional shape that matches the shape of aperture 107 and/or allows the tongue prong 112 to be received in aperture 107 and fit there securely. In some embodiments, tongue prong 112 may be a different cross-sectional shape than the shape of aperture 107 but may be sized smaller to be received in that aperture. The tongue prong and tongue bridge may sometimes be referred to as a "projection assembly." Panel 100 may be described as having first end prong 108, second end prong 109, the remainder of prongs disposed between the first and second end prongs, and tongue prong 112 attached to the second end prong via tongue bridge 111.

Figure 4:
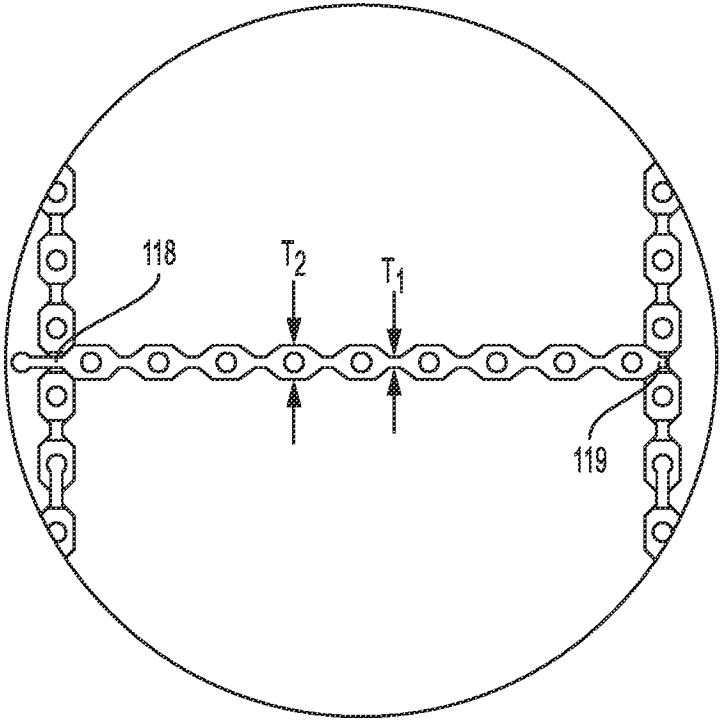
FIG. 4 is a partial top view of the panel of FIG. 2 attached to third and fourth panels.
Figure 3:
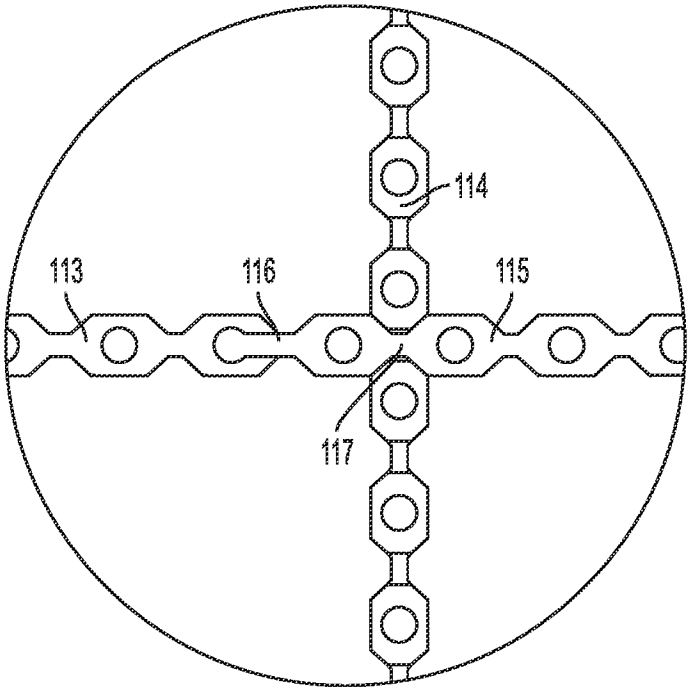
FIG. 3 is a partial top view of the panel of FIG. 2 attached to a second panel.

FIGS. 3-4 represent the top views of various panels of panel assembly 22 attached to each other. As explained in more detail below, the disclosed embodiment includes at least two types of panel attachments: longitudinal and perpendicular. FIG. 3 shows panels 113 and 115 attached longitudinally to each other with the longitudinal connection shown at 116. Additionally, FIG. 3 shows panels 114 and 115 attached perpendicularly to each other with the perpendicular connection shown at 117. Panels 114 and 115 comprise perpendicular attachment 117 in the areas of their inner bridges, i.e. bridges not connected to a tongue prong or slit prong. FIG. 4 shows other configurations that may be achieved by attaching panels perpendicularly. For example, perpendicular attachment with one of the panels attached through its bridge that connects to a tongue prong is shown at 118. Additionally, perpendicular attachment with one of the panels having its portion separated past the bridge that is being involved in the attachment is shown at 119. Panels can be attached perpendicularly by inserting a bridge of a first panel inside a cavity of a second panel. While a bridge of a first panel is received in a cavity of a second panel, a bridge of the second panel is received in a cavity of the first panel (see FIGS. 8-10 for detailed illustration). Properly matched sizes and shapes of the bridges and cavities provide secure perpendicular attachments. Also shown in FIG. 4 are thicknesses of a bridge and a prong, shown as $T_1$ and $T_2$ respectively (which are measured perpendicular to the longitudinal axes defined by the prongs and/or its apertures).

Although in the disclosed embodiment panels can be attached to each other either longitudinally or perpendicularly, other embodiments that include an option of oblique attachment of two panels are possible, and can be achieved with different outer shapes of the prongs and variable lengths of the bridges. For example, the prongs may have a shape of right rhombic prism and the bridges may be of two different lengths: short bridges and long bridges. The short and long bridges may alternate: short bridge may be followed by a prong which is followed by a long bridge that is followed by another prong which is followed by another short bridge, etc. Widths of cavities may match the lengths of bridges: narrow cavities may be located opposite to short bridges, and wide cavities may be located opposite to long bridges. With suitable sizes of the short and long bridges, a short bridge of a first panel may be received in a wide cavity of a second panel, locking rhombic prisms of the first panel against rhombic prisms of the second panel. An angle between the panel attached in this way will be congruent with an angle formed by two adjacent sides of a cross-sectional rhomb.

Figure 5:
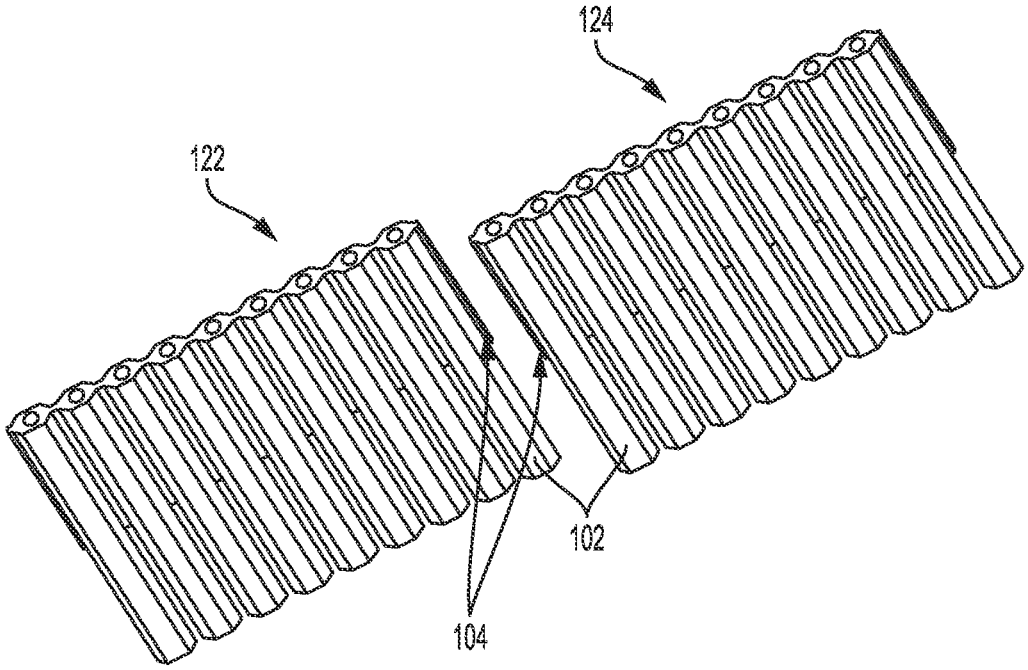
FIG. 5 is another isometric view of the panel of FIG. 2, showing a portion detached from another portion of the panel.

FIG. 5 shows two panel portions 122 and 124. These portions could be attained by partitioning a single panel. Portions of a panel of various lengths may be required to achieve a desired configuration of a panel assembly designed to fit in a storage space of specific shape and dimensions. Partitioning of a panel may be performed by fracturing or separating the panel along a bridge 104. Bridges 104 may be constructed in a manner and of appropriate material to facilitate easy partitioning of a panel. In the disclosed embodiment thickness $T_1$ of the bridges 104 is less (or substantially less) than thickness $T_2$ of the prongs 102 as shown in FIG. 4. This allows for easy fracturing of a panel along one or more of its bridges without damaging the rest of the panel structure. In other embodiments, for example, perforations (not shown) running across all or some of the bridges 104 and extending in the direction parallel to prongs may be included.

Figure 6:
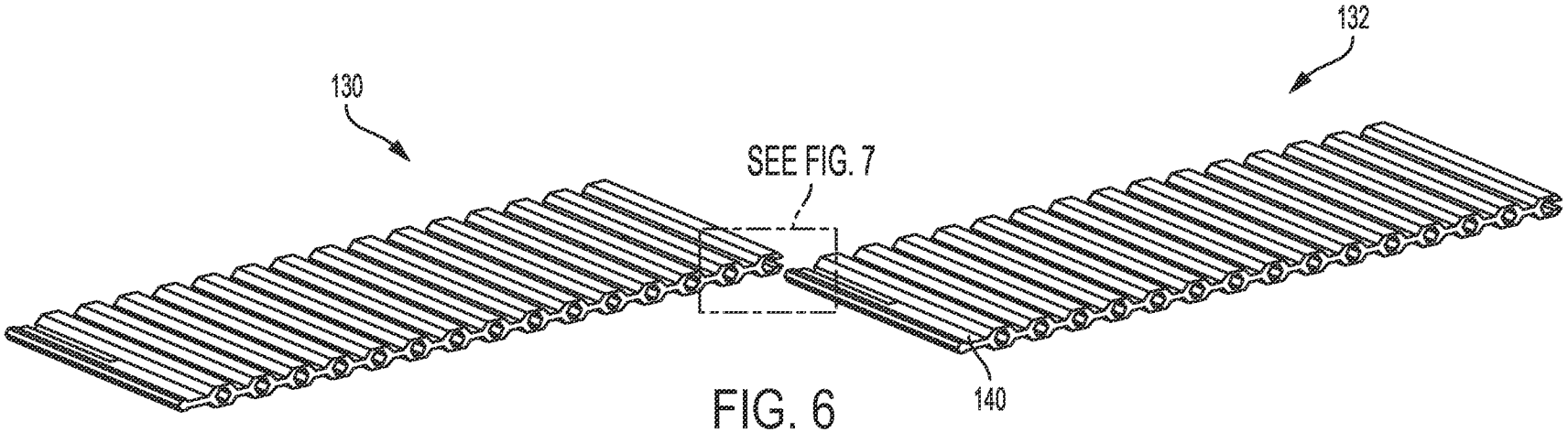
FIG. 6 is an isometric view of two panels of the modular organizer system of FIG. 1, shown the two panels aligned for parallel connection.
Figure 7:
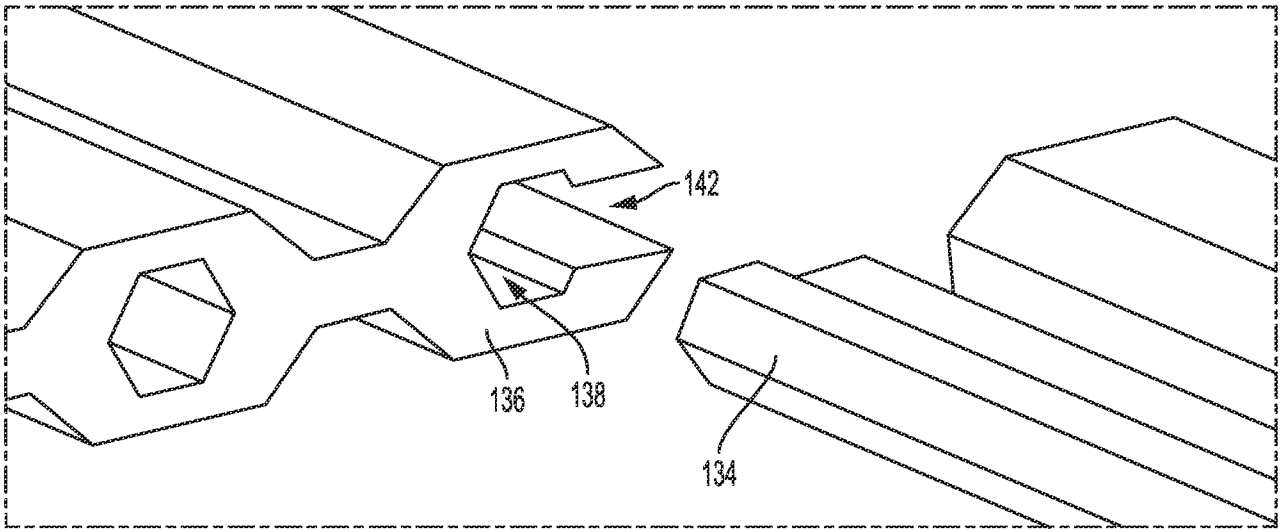
FIG. 7 is a partial view of the two panels of FIG. 6.

FIGS. 6-7 illustrate the process of attaching longitudinally a first panel 130 and a second panel 132, both as previously described. Longitudinal attachment may be performed by (1) aligning panels 130 and 132 so that the side of a tongue prong 134 of panel 132 is positioned against or adjacent the bridge side of a slit prong 136 of panel 130, and 2) moving the panels 130 and 132 relative to each other so that the tongue prong 134 of panel 132 is received in the aperture 138 of the slit prong 136 of panel 130 and the tongue bridge 140 connecting the tongue prong 134 of panel 132 is received in the slit 142 of the slit prong 136 of panel 130. Aperture 138 may sometimes be referred to as a "distal portion" of the opening of the slit prong, while slit 142 may sometimes be referred to as a "proximal portion" of the opening of the slit prong. When longitudinal attachment is complete, the attached panels 130 and 132 may appear and may be used as a single panel. In the disclosed embodiment, tongue prong has the shape of hexagonal prism, and the aperture of a slit prong has the matching hexagonal shape. In other possible embodiments, tongue prong and slit prong aperture may comprise any matching shapes that would allow a tongue prong to be received and fit snugly in a slit prong aperture.

Figure 8:
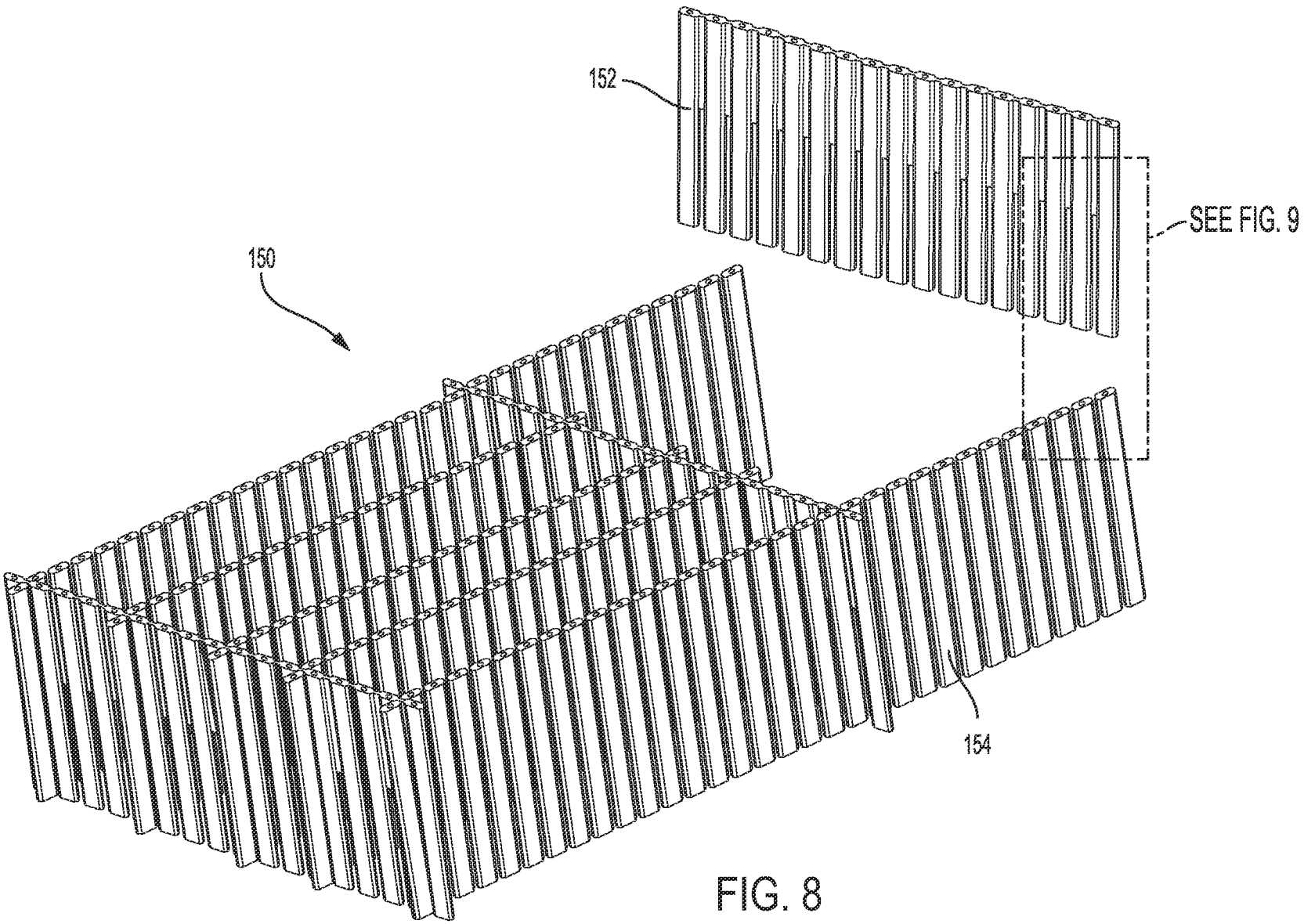
FIG. 8 is an isometric view of various panels of the modular organizer system of FIG. 1, shown connected to each other except for an end panel.
Figure 10:
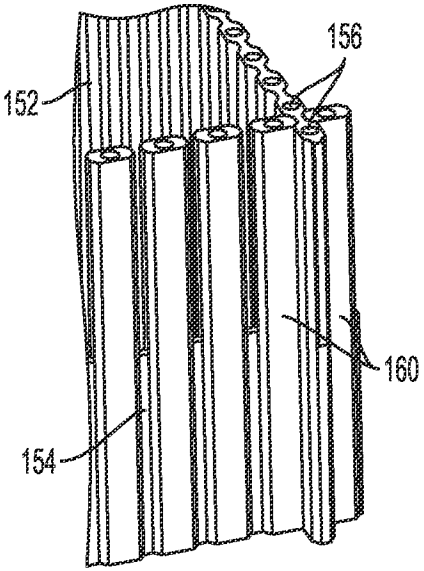
FIG. 10 is a partial view of FIG. 9 showing the end panel of FIG. 8 connected to the other panels.
Figure 9:
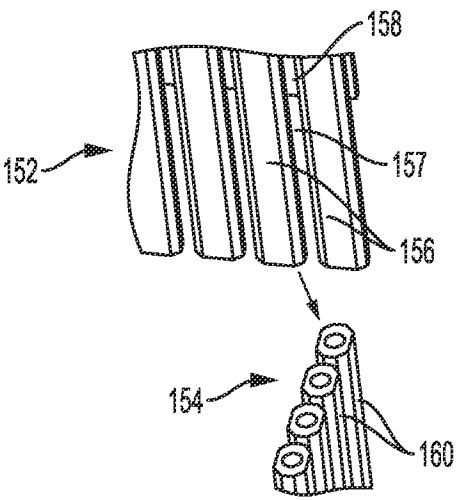
FIG. 9 is a partial view of the end panel of FIG. 8 being connected to the connected panels.

FIGS. 8-10 show a first panel 152 of panel assembly 150 being perpendicularly attached to a second panel 154 of the panel assembly. Perpendicular attachment may be performed by 1) positioning two panels perpendicularly, first panel located above second panel, 2) orienting the first panel so that its bridges are at the top and orienting the second panel so that its bridges are at the bottom, 3) aligning two panels so that a slot comprised by unfilled space between two prongs of the first panel is positioned against a slot comprised by unfilled space between two prongs of the second panel, and 4) sliding down the first panel so that a bridge of the first panel is received in a slot comprised by unfilled space between two prongs of the second panel and a bridge of the second panel is received in a slot comprised by unfilled space between two prongs of the first panel. FIG. 8 shows a panel assembly 150 and its first panel 152 being positioned perpendicularly and above its second panel 154. FIG. 9 is a partial view showing a slot 157 comprised by unfilled space or cavity between two prongs 156 of the first panel 152 positioned against a slot comprised by unfilled space or cavity between two prongs 160 of the second panel 154. When attaching the panels 152 and 154 is completed, bridge 158 of the first panel 152 will be received in the slot comprised by unfilled space between two prongs 160 of the second panel 154. FIG. 10 shows panels 152 and 154 attached with the process of perpendicular attachment completed.

Figure 11:
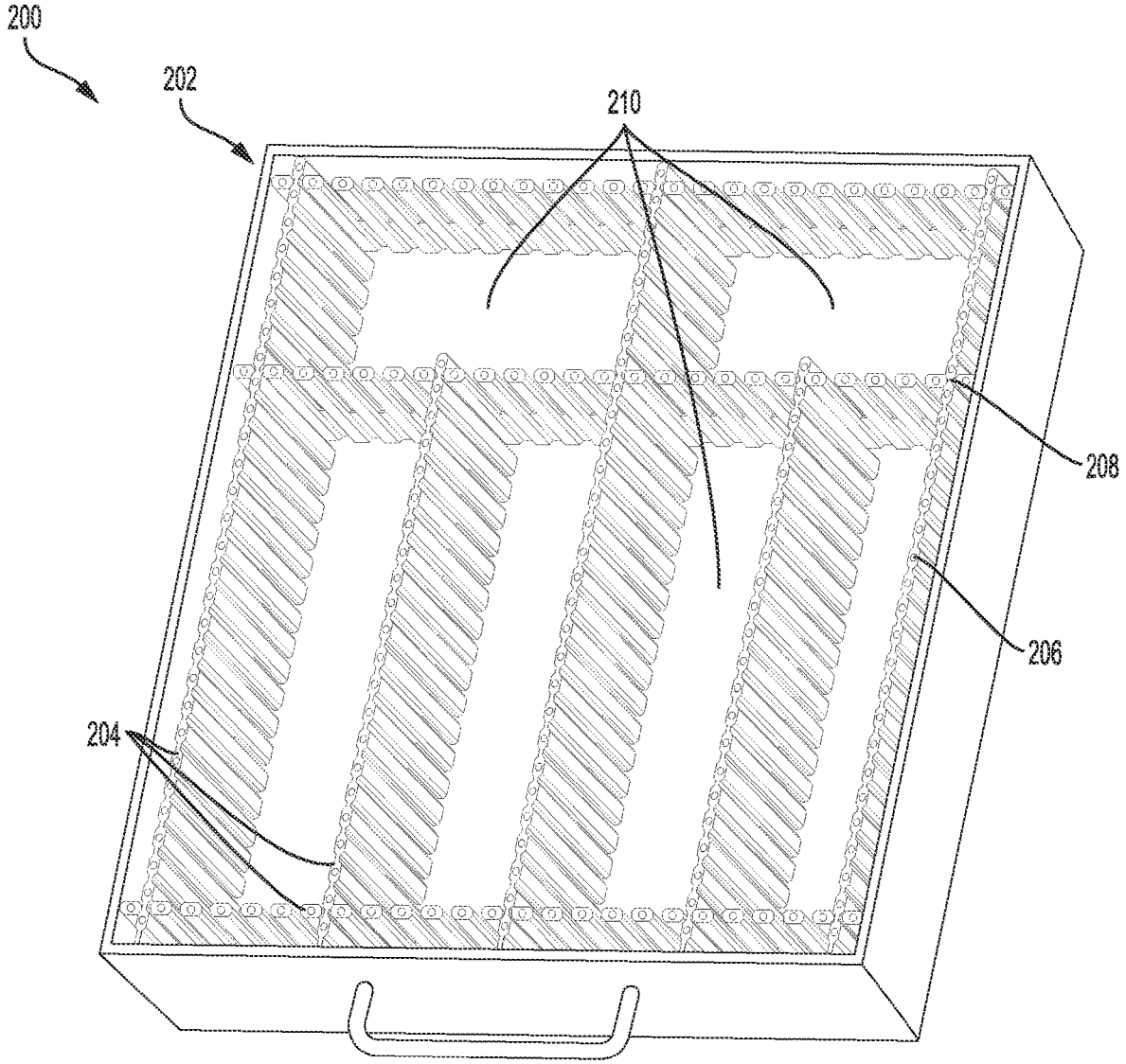
FIG. 11 is an isometric view of the modular organizer system of FIG. 1, showing assembled and positioned in an illustrative drawer.

FIG. 11 shows an assembled modular organizer system positioned in a drawer and generally indicated as 200. It includes a panel assembly 202 constructed of multiple panels 204 held together by longitudinal 206 and perpendicular 208 attachments. In the pictured example, panel assembly 202 comprises 16 panels of unequal lengths. As explained above, panels of various lengths can be obtained by partitioning. The exemplary system 202 includes plurality of compartments 210 that may serve the system's intended purpose of segregated storage of various items at well-defined locations. It should be noted that the modular organizer system shown in FIG. 11 is only one of great plurality of possible configurations and in general, a modular organizer system is not limited to any particular arrangement and is highly customizable and adjustable.

Figure 12:
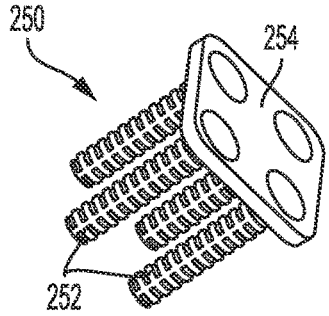
FIG. 12 is an example of a fastener assembly of the modular organizer system of FIG. 1.

FIG. 12 shows a fastener assembly or fastener 250, which is an example of support assembly 24. Fastener 250 may include two, three, four or more connectors or bolts 252 connected to, or formed with, a fastener base or top plate 254. The bolts are configured to be received into apertures 106 of prongs 102. In some examples, the bolts and the apertures may include matching threads or protrusions for secure attachment of bolts to the panels. Although top plate 254 is shown to have a square shape (along the plane of the top plate), the top plate may alternatively have a rectangular, circular, triangular, and/or any suitable shape(s). In the disclosed embodiment the bolts 252 are attached to top plates 254 in a configuration that supports the bolts being received into apertures of prongs belonging to panels attached perpendicularly. In embodiments that allow for oblique attachments the support assembly 24 may contain fasteners 250 with their bolts 252 attached to their top plates 254 in a configuration supporting the oblique attachments. An embodiment that supports more than one non-longitudinal type of attachment may comprise plurality of fasteners with different configurations of the bolts, each configuration corresponding to one type of the supported non-longitudinal attachments. When a fastener 250 is placed into aperture 106, its top plate 254 may contact a top surface of prongs 102. Plurality of fasteners 250 may comprise a sole component of support assembly 24, or may comprise one of plurality of components of support assembly 24.

Figure 13:
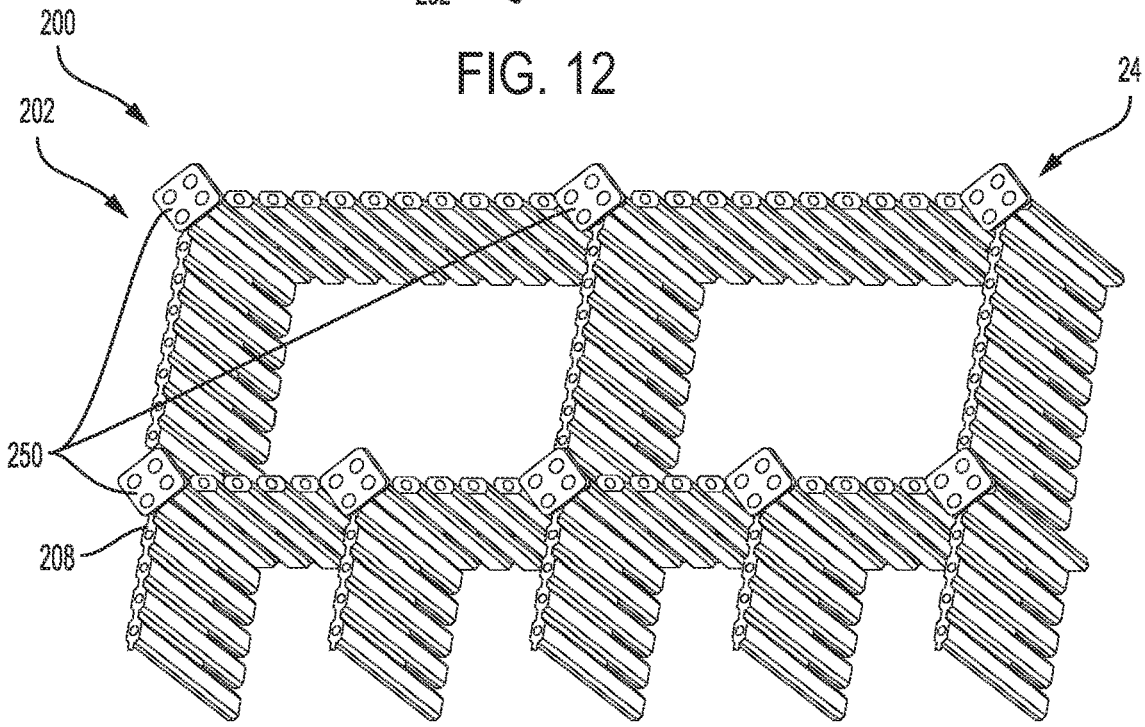
FIG. 13 is a partial isometric view of the modular organizer system of FIG. 1, showing the fastener assemblies of FIG. 12 attached to various panels.
Figure 14:
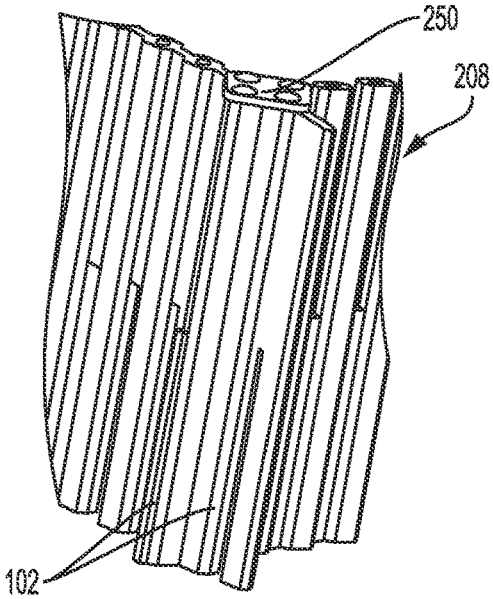
FIG. 14 is a partial view of the modular organizer system of FIG. 13.

FIG. 13 shows modular organizer system 200 that further includes elements of support assembly 24. In this example the modular organizer system includes plurality of fastener assemblies 250 that secure perpendicular connections 208 of panel assembly 202, which prevent any two perpendicularly attached panels from sliding relative to each another to reinforce the structural stability of modular organizer system 200. In the pictured example, eight fasteners 250 are used to secure eight perpendicular connections 208. In other configurations of a modular organizer system, larger or smaller number of perpendicular attachments may be present and larger or smaller number of fasteners may be required. FIG. 14 is a partial view showing a perpendicular connection 208 secured by a fastener 250. The fastener extends its bolts into apertures of prongs 102 belonging to two distinct panels attached to each other perpendicularly.

Figure 15:
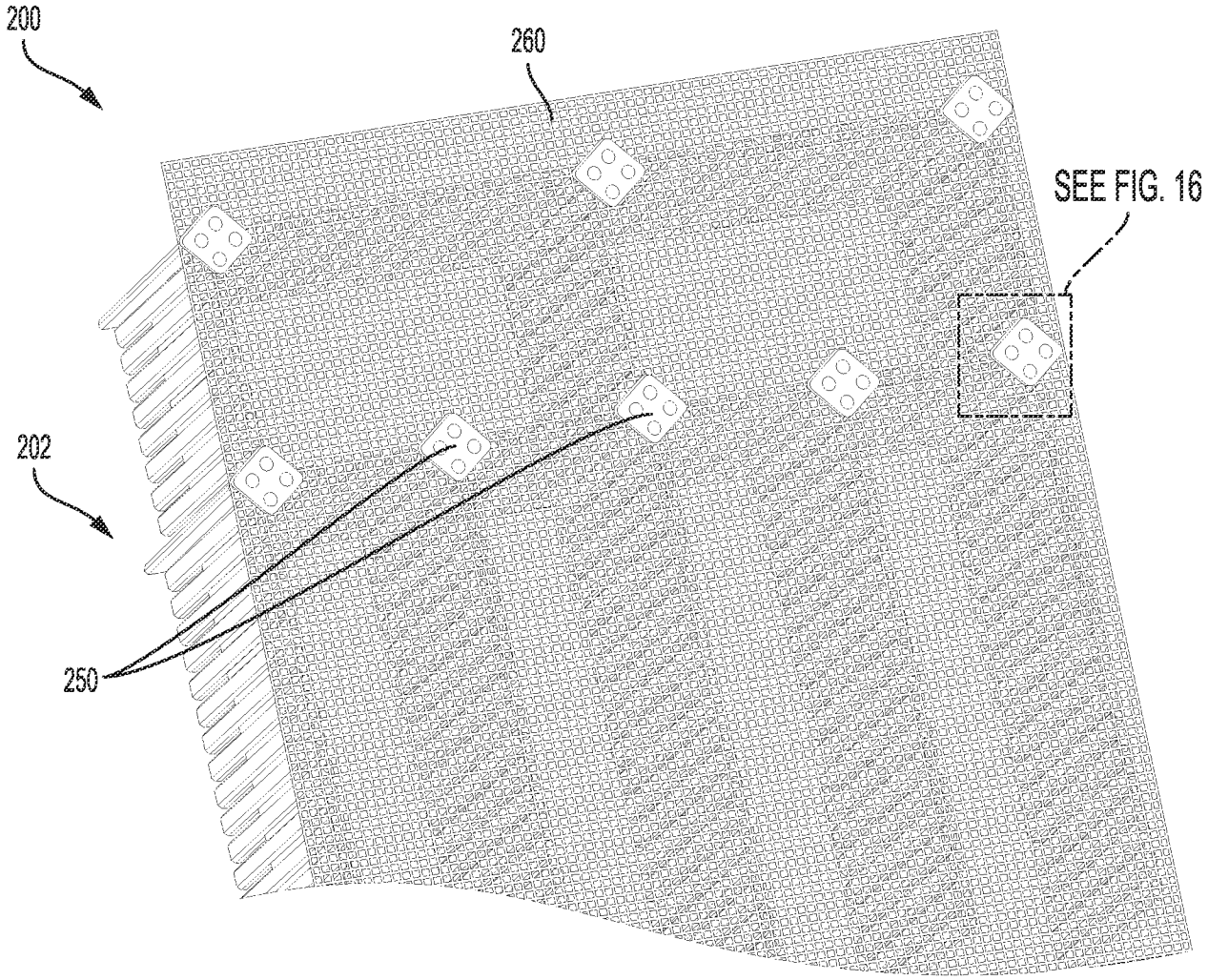
FIG. 15 is an isometric view of the modular organizer system of FIG. 1, shown assembled with the fastener assemblies of FIG. 12 and an example of a base.
Figure 16:
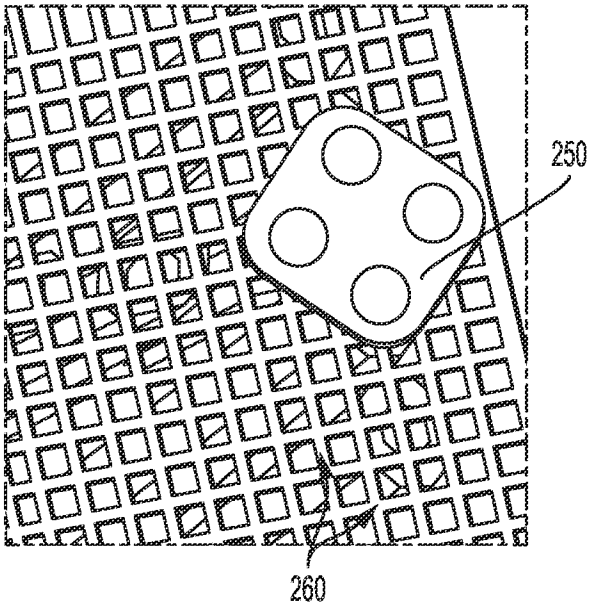
FIG. 16 is a partial view of the modular organizer system of FIG. 15.

FIGS. 15-16 show modular organizer system 200 further including components of support assembly 24 and base assembly 26. In the pictured example, base assembly 26 comprises a rectangular base or screen panel 260. The screen panel includes apertures that receive bolts 252 of fasteners 250 thereby allowing the screen panel to be attached securely to panel assembly 202 by means of the fasteners. In this example, fasteners 250 are used for securing panels' perpendicular attachments and attachment of the screen panel to the panel assembly. Screen panel 260 may match the dimensions and shape of panel assembly 202 and cover some or all compartments 210. Screen panel 260 may comprise a sole component of base assembly 26, or may comprise one of plurality of components of base assembly 26. The base assembly 26 may be secured to panel assembly 202 by components of support assembly 24 other than fasteners, or by its own components, or in any other suitable manner. In other embodiments, base assembly 26 may include a solid panel with only a few apertures. The solid panel may have any desirable shape(s) and/or size(s). Although fasteners 250 and base 260 are shown as discrete components, the base may, in other embodiments, incorporate the fasteners or the connectors of the fasteners.

ILLUSTRATIVE COMBINATIONS AND ADDITIONAL EXAMPLES

This section describes additional aspects and features of modular organizer systems, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-Reference to Related Applications, in any suitable manner. Some of the paragraphs below expressly refer to and further limit other paragraphs, providing without limitation examples of some of the suitable combinations.

A0. A first panel, comprising:

a plurality of elongate and parallel structural members, each structural member of the plurality of structural members having a first portion and a second portion;

a plurality of bridges that are attached to, or formed with, the first portion of the plurality of structural members such that (a) a bridge of the plurality of bridges spans between the first portions of each pair of adjacent structural members of the plurality of structural members and (b) a cavity is defined between the second portions of each pair of adjacent structural members of the plurality of structural members, wherein one or more bridges of the plurality of bridges is sized to be received in a cavity of a second panel to attach the first and second panels together, wherein the plurality of structural members includes a first end structural member, an opposed second structural end member, and the remainder of structural members of the plurality of structural members therebetween; and a projection assembly attached to, or formed with, the first portion of the first end structural member, the projection assembly including a projection member and a projection bridge that spans between the projection member and at least the first portion of the first end structural member, wherein the projection member and a portion of the projection bridge are configured to be received in the second end structural member of a third panel to attach the first and third panels together, and wherein the second end structural member includes an opening configured to receive at least a portion of a projection assembly of a fourth panel to attach the first and fourth panels together.

A1. The first panel of paragraph A0, wherein the projection bridge has a first thickness and the projection member has a second thickness larger than the first thickness.

A2. The first panel of any of paragraphs A0-A1, wherein the projection bridge has a first shape and the projection member has a second shape different from the first shape.

A3. The first panel of any of paragraphs A0-A2, wherein the opening of the second end structural member includes a distal portion configured to receive a projection member of the fourth panel and a proximal portion configured to receive a portion of a projection bridge of the projection assembly of the fourth panel.

A4. The first panel of paragraph A3, wherein the proximal portion has a first thickness and the distal portion has a second thickness larger than the first thickness.

A5. The first panel of paragraph A4, where the plurality of structural members defines a plurality of longitudinal axes, wherein the first and second thicknesses are measured perpendicular to the plurality of longitudinal axes.

A6. The first panel of any of paragraph A0-A5, wherein one or more structural members of the plurality of structural members are hollow along at least a portion of its length.

A7. The first panel of paragraph A6, wherein all the structural members of the plurality of structural members is hollow along at least a portion of its length.

A8. The first panel of any of paragraphs A0-A7, wherein one or more structural members of the plurality of structural members have a hexagonal cross-section.

A9. The first panel of paragraph A8, wherein all the structural members of the plurality of structural members has a hexagonal cross-section.

A10. The first panel of any of paragraphs A0-A9, wherein the plurality of structural members has a first thickness and the plurality of bridges has a second thickness that is less than the first thickness.

A11. The first panel of paragraph A10, wherein the plurality of structural members has a first thickness and the plurality of bridges has a second thickness that is substantially less than the first thickness.

A12. The first panel of any of paragraphs A10-A11, where the plurality of structural members defines a plurality of longitudinal axes, wherein the first and second thicknesses are measured perpendicular to the plurality of longitudinal axes.

A13. The first panel of any of paragraphs A0-A12, wherein the first portion is an upper half portion of the plurality of structural members, and the second portion is a lower half portion of the plurality of structural members.

A14. The first panel of any of paragraphs A0-A13, wherein each bridge of the plurality of bridges is sized to be received in a cavity of the second panel.

B0. A modular organizer system, comprising a plurality of panels, each panel of the plurality of panels including:

a plurality of elongate and parallel structural members including a first end structural member, an opposed second structural end member, and the remainder of structural members therebetween, each structural member of the plurality of structural members having a first portion and a second portion;

a plurality of bridges that are attached to, or formed with, the first portion of the plurality of structural members such that the second portion of each structural member of the plurality of structural members is spaced apart from the second portion of an adjacent structural member of the plurality of structural members to define a cavity therebetween, wherein one or more bridges of the plurality of bridges is sized to be received in a cavity of another panel of the plurality of panels; and a projection assembly attached to, or formed with, the first portion of the first end structural member, wherein at least a portion of the projection assembly is configured to be received in a second end structural member of another panel of the plurality of panels, wherein the second end structural member includes an opening configured to receive at least a portion of a projection assembly of another panel of the plurality of panels.

B1. The system of paragraph B0, wherein the projection assembly includes a projection member and a projection bridge that spans between the projection member and at least the first portion of the first end structural member, and wherein the projection member and a portion of the projection bridge is configured to be received in the opening of the second end structural member of another panel of the plurality of panels.

B2. The system of paragraph B1, wherein the projection bridge has a first thickness and the projection member has a second thickness larger than the first thickness.

B3. The system of any of paragraphs B1-B2, wherein the projection bridge has a first shape and the projection member has a second shape different from the first shape.

B4. The system of any of paragraphs B1-B3, wherein the opening of the second end structural member includes a first portion configured to receive the projection member of another panel of the plurality of panels and a second portion configured to receive a portion of a projection bridge of the projection assembly of another panel of the plurality of panels.

B5. The system of any of paragraphs B0-B4, wherein one or more structural members of the plurality of structural members are hollow along at least a portion of its length.

B6. The system of paragraph B5, wherein all the structural members of the plurality of structural members is hollow along at least a portion of its length.

B7. The system of any of paragraphs B0-B6, wherein one or more structural members of the plurality of structural members have a hexagonal cross-section.

B8. The system of paragraph B7, wherein all the structural members of the plurality of structural members has a hexagonal cross-section.

B9. The system of any of paragraphs B0-B8, wherein the plurality of structural members has a first thickness and the plurality of bridges has a second thickness that is substantially less than the first thickness.

B10. The system of paragraph B9, where the plurality of structural members defines a plurality of longitudinal axes, wherein the first and second thicknesses are measured perpendicular to the plurality of longitudinal axes.

B11. The system of any of paragraphs B0-B10, further comprising a fastener assembly having a fastener base and at least two connectors attached to the fastener base, the fastener assembly being distinct and separate from the plurality of panels.

B12. The system of paragraph B11, wherein one or more structural members of the plurality of structural members includes an end portion having an aperture, wherein the aperture is sized to receive a connector of the at least two connectors of the fastener assembly.

B13. The system of paragraph B12, wherein one or more structural members of the plurality of structural members includes two opposed end portions each having an aperture, wherein the aperture is sized to receive a connector of the at least two connectors of the fastener assembly.

B14. The system of any of paragraphs B12-B13, further comprising a base having a plurality of base openings, wherein each base opening of the plurality of base openings is sized to receive a connector of the at least two connectors.

B15. The system of paragraph B14, wherein the fastener assembly is configured to attach the base to a panel of the plurality of panels when one or more connectors of the at least two connectors are received in one or more base openings of the plurality of base openings and are received in one or more apertures of the one or more structural members.

B16. The system of any of paragraphs B12-B15, wherein all the structural members of the plurality of structural members includes two opposed end portions each having an aperture, wherein the aperture is sized to receive a connector of the at least two connectors of the fastener assembly.

C. A modular organizer system, comprising:

a plurality of panels, each panel of the plurality of panels including:

a plurality of elongate and parallel structural members, each structural member of the plurality of structural members having a first portion and a second portion, wherein the plurality of structural members includes a first end structural member, an opposed second structural end member, and the remainder of structural members of the plurality of structural members therebetween, a plurality of bridges that are attached to, or formed with, the first portion of the plurality of structural members such that (a) a bridge of the plurality of bridges spans between the first portions of each pair of adjacent structural members of the plurality of structural members and (b) a cavity is defined between the second portions of each pair of adjacent structural members of the plurality of structural members, wherein each bridge of the plurality of bridges is sized to be received in one or more cavities of another panel of the plurality of panels, wherein the plurality of structural members has a first thickness and the plurality of bridges has a second thickness that is substantially less than the first thickness, and a projection assembly attached to, or formed with, the first portion of the first end structural member, the projection assembly including a projection member and a projection bridge that spans between the projection member and at least the first portion of the first end structural member, wherein the projection member and a portion of the projection bridge are configured to be received in the second end structural member of another panel of the plurality of panels, and wherein the second end structural member includes an opening configured to receive at least a portion of the projection assembly of another panel of the plurality of panels;

a fastener assembly having a fastener base and at least two connectors attached to the fastener base, wherein one or more structural members of the plurality of structural members includes an end portion having an aperture, wherein the aperture is sized to receive a connector of the at least two connectors of the fastener assembly; and a base having a plurality of base openings, wherein each base opening of the plurality of base openings is sized to receive a connector of the at least two connectors, wherein the fastener assembly is configured to attach the base to a panel of the plurality of panels when one or more connectors of the at least two connectors are received in one or more base openings of the plurality of base openings and are received in the aperture of the end portion of the one or more structural members.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A first panel, comprising:

a plurality of elongate and parallel structural members, each structural member of the plurality of structural members having a first portion and a second portion, each structural member defining a first longitudinal axis;

a plurality of bridges that are attached to, or formed with, the first portion of the plurality of structural members such that (a) a bridge of the plurality of bridges spans between the first portions of each pair of adjacent structural members of the plurality of structural members, wherein the bridge spans along a second axis that is perpendicular to the first longitudinal axis, and (b) a cavity is defined between the second portions of each pair of adjacent structural members of the plurality of structural members, wherein one or more bridges of the plurality of bridges is sized to be received in a cavity of a second panel to attach the first and second panels together, wherein the plurality of structural members includes a first end structural member, an opposed second structural end member, and the remainder of structural members of the plurality of structural members therebetween; and a projection assembly attached to, or formed with, the first portion of the first end structural member, the projection assembly including an elongate projection member and a projection bridge that spans along the second axis between the projection member and at least the first portion of the first end structural member, wherein the projection member and a portion of the projection bridge are configured to be received in the second end structural member of a third panel to attach the first and third panels together, and wherein the second end structural member is hollow and includes a central channel that extends along the first longitudinal axis from one end of the second end structural member to the other opposed end of the second end structural member, wherein the second end structural member further includes an elongate slit that extends along a third axis that is parallel to the first longitudinal axis from the one end to the other opposed end of the second end structural member, the elongate slit is adjacent to the central channel and spaced from the bridge that connects the second end structural member to an adjacent structural member of the remainder of structural members, the elongate slit has a first thickness measured along a fourth axis that is perpendicular to both the first and second axes, and the central channel has a second thickness measured along a fifth axis that is parallel to the fourth axis, the second thickness is larger than the first thickness, the elongate slit is connected to the central channel such that both the elongate slit and the central channel receive at least a portion of a projection assembly of a fourth panel to attach the first and fourth panels together.

2. The first panel of claim 1, wherein each structural member of the plurality of structural members is hollow and includes a central channel from one end of the structural member to the other end of the structural member along the first longitudinal axis.

3. The first panel of claim 2, wherein each structural member of the plurality of structural members has the same cross-sectional shape in a plane that is perpendicular to the first longitudinal axis except that the second end structural member includes the elongate slit, and the cross-sectional shape of each structural member is the same from one end of the structural member to the other end of the structural member along the first longitudinal axis.

4. The first panel of claim 3, wherein the channel the second end structural member is sized receive a projection member of the fourth panel and the elongate slit of the second end structural member is sized to receive a portion of a projection bridge of the projection assembly of the fourth panel when the first panel is attached to the fourth panel.

5. The first panel of claim 4, wherein the cross-sectional shape of each structural member of the plurality of structural members in a plane that is perpendicular to the first longitudinal axis is hexagonal.

6. A modular organizer system, comprising a plurality of panels, each panel of the plurality of panels including:

a plurality of elongate and parallel structural members including a first end structural member, an opposed second structural end member, and the remainder of structural members therebetween, each structural member of the plurality of structural members having a first portion and a second portion, each structural member defining a first longitudinal axis, wherein the second end structural member includes a central channel that extends along the first longitudinal axis from one end of the second end structural member to the other opposed end of the second end structural member;

a plurality of bridges that are attached to, or formed with, the first portion of the plurality of structural members such that the second portion of each structural member of the plurality of structural members is spaced apart from the second portion of an adjacent structural member of the plurality of structural members to define a cavity therebetween, wherein one or more bridges of the plurality of bridges is sized to be received in a cavity of another panel of the plurality of panels, wherein each bridge of the plurality of bridges spans along a second axis that is perpendicular to the first longitudinal axis; and a projection assembly attached to, or formed with, the first portion of the first end structural member, the projection assembly including an elongate projection member and a projection bridge that spans between the projection member and at least the first portion of the first end structural member, wherein the projection member and a portion of the projection bridge are configured to be received in the second end structural member of a second panel of the plurality of panels to attach the panels together, wherein the second end structural member further includes an elongate slit that extends along a third axis that is parallel to the first longitudinal axis from the one end to the other opposed end of the second end structural member, wherein the elongate slit is adjacent to the central channel and spaced from the bridge that connects the second end structural member to an adjacent structural member of the remainder of structural members, wherein the elongate slit has a first thickness measured along a fourth axis that is perpendicular to both the first and second axes, and the central channel has a second thickness measured along a fifth axis that is parallel to the fourth axis, wherein the second thickness is larger than the first thickness, wherein the elongate slit is connected to the central channel, wherein the elongate slit is sized to receive the projection bridge of the projection assembly of a third panel of the plurality of panels, and the central channel is sized to receive the projection member of the projection assembly of the third panel to attach the panels together.

7. The system of claim 6, wherein each structural member of the plurality of structural members includes a central channel from one end of the structural member to the other end of the structural member along the first longitudinal axis.

8. The system of claim 6, wherein each structural member of the plurality of structural members has the same cross-sectional shape in a plane that is perpendicular to the first longitudinal axis except that the second end structural member includes the elongate slit.

9. The system of claim 8, wherein the cross-sectional shape of each structural member is the same from one end of the structural member to the other end of the structural member along the first longitudinal axis.

10. The system of claim 9, wherein the cross-sectional shape of each structural member of the plurality of structural members in a plane that is perpendicular to the first longitudinal axis is hexagonal.

11. The system of claim 6, wherein each bridge of the plurality of bridges has a first width measured along the second axis, and wherein the projection bridge has a second width measured along the second axis and the second width is greater than the first width.

12. The system of claim 6, further comprising a fastener assembly having a plate and at least two connectors attached to the plate, the fastener assembly being distinct and separate from the plurality of panels.

13. The system of claim 12, wherein each structural member of the plurality of structural members includes a central channel from one end of the structural member to the other end of the structural member along the first longitudinal axis, and wherein each connector of the at least two connectors is sized to be received in the central channel of a structural member of the plurality of structural members.

14. The system of claim 13, where each panel of the plurality of panels has a panel width measured along the second axis, further comprising a planar base having a plurality of base openings, wherein each base opening of the plurality of base openings is sized to receive a connector of the at least two connectors, and wherein the base has a base length that is at least equal to the panel width of a panel of the plurality of panels and a base width that is at least equal to the panel width of a panel of the plurality of panels.

15. The system of claim 14, wherein a first connector of the at least two connectors is configured to be received in a first base opening of the plurality of base openings and in a first central channel of a first end portion of a fourth panel of the plurality of panels when the first connector is received in the first base opening, and wherein a second connector of the at least two connectors is configured to be received in a second base opening of the plurality of base openings and in a second central channel of a second end portion of a fifth panel of the plurality of panels when the second connector is received in the second base opening such that the base is disposed between the fastener assembly and the fourth and fifth panels.

16. A modular organizer system, comprising:

a plurality of panels, each panel of the plurality of panels including:

a plurality of elongate and parallel structural members, each structural member of the plurality of structural members having a first portion and a second portion, each structural member defining a first longitudinal axis, each structural member of the plurality of structural members includes a central channel from one end of the structural member to the other end of the structural member along the first longitudinal axis, wherein the plurality of structural members includes a first end structural member, an opposed second structural end member, and the remainder of structural members of the plurality of structural members therebetween, a plurality of bridges that are attached to, or formed with, the first portion of the plurality of structural members such that (a) a bridge of the plurality of bridges spans between the first portions of each pair of adjacent structural members of the plurality of structural members and (b) a cavity is defined between the second portions of each pair of adjacent structural members of the plurality of structural members, wherein each bridge of the plurality of bridges is sized to be received in one or more cavities of another panel of the plurality of panels, wherein each bridge of the plurality of bridges spans along a second axis that is perpendicular to the first longitudinal axis, wherein each panel of the plurality of panels has a panel width measured along the second axis, wherein the plurality of structural members has a first thickness and the plurality of bridges has a second thickness that is substantially less than the first thickness, and a projection assembly attached to, or formed with, the first portion of the first end structural member, the projection assembly including a projection member and a projection bridge that spans between the projection member and at least the first portion of the first end structural member, the projection assembly including an elongate projection member and a projection bridge that spans between the projection member and at least the first portion of the first end structural member, wherein the projection member and a portion of the projection bridge are configured to be received in the second end structural member of a second panel of the plurality of panels to attach the panels together, wherein the second end structural member includes an elongate slit that extends along a third axis that is parallel to the first longitudinal axis from the one end to the other opposed end of the second end structural member, the elongate slit is adjacent to the central channel of the second end structural member and spaced from the bridge that connects the second end structural member to an adjacent structural member of the remainder of structural members, the elongate slit has a first thickness measured along a fourth axis that is perpendicular to both the first and second axes, and the central channel has a second thickness measured along a fifth axis that is parallel to the fourth axis, the second thickness is larger than the first thickness, the elongate slit is connected to the central channel, the elongate slit is sized to receive the projection bridge of the projection assembly of a third panel of the plurality of panels, and the central channel is sized to receive the projection member of the projection assembly of the third panel to attach the first and third panels together, wherein each structural member of the plurality of structural members has the same cross-sectional shape in a plane that is perpendicular to the first longitudinal axis except that the second end structural member includes the elongate slit, and wherein the cross-sectional shape of each structural member is the same from one end of the structural member to the other end of the structural member along the first longitudinal axis;

a fastener assembly having a plate and at least two connectors attached to the plate, wherein each connector of the at least two connectors is sized to be received in the central channel of a structural member of the plurality of structural members; and a planar base having a plurality of base openings, wherein each base opening of the plurality of base openings is sized to receive a connector of the at least two connectors, wherein the base has a base length that is at least equal to the panel width of a panel of the plurality of panels and a base width that is at least equal to the panel width of a panel of the plurality of panels, wherein a first connector of the at least two connectors is configured to be received in a first base opening of the plurality of base openings and in a first central channel of a first end portion of a first panel of the plurality of panels when the first connector is received in the first base opening, and wherein a second connector of the at least two connectors is configured to be received in a second base opening of the plurality of base openings and in a second central channel of a second end portion of a second panel of the plurality of panels when the second connector is received in the second base opening such that the base is disposed between the fastener assembly and the first and second panels.

17. The system of claim 16, wherein the cross-sectional shape of each structural member of the plurality of structural members in a plane that is perpendicular to the first longitudinal axis is hexagonal.

* * * * *